US010493445B2

(12) United States Patent
Pierik et al.

(10) Patent No.: US 10,493,445 B2
(45) Date of Patent: Dec. 3, 2019

(54) FLUIDIC SYSTEM FOR PROCESSING A SAMPLE FLUID

(71) Applicant: KONINKLIJKE PHILIPS N.V., Eindhoven (NL)

(72) Inventors: Anke Pierik, Eindhoven (NL); Reinhold Wimburger-Friedl, Veldhoven (NL); Johannes Theodorus Wilhelmus Maria Van Eemeren, Helmond (NL); Irene Johanna Monia Dobbelaer-Bosboom, Esch (NL); Martinus Johannes Van Zelst, Eindhoven (NL); Bernadet Dagmar Marielle Meijering, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 510 days.

(21) Appl. No.: 14/786,254

(22) PCT Filed: Apr. 29, 2014

(86) PCT No.: PCT/EP2014/058703
§ 371 (c)(1),
(2) Date: Oct. 22, 2015

(87) PCT Pub. No.: WO2014/177551
PCT Pub. Date: Nov. 6, 2014

(65) Prior Publication Data

US 2016/0074858 A1 Mar. 17, 2016

(30) Foreign Application Priority Data

Apr. 30, 2013 (EP) ..... 13165974

(51) Int. Cl.
*B01L 3/00* (2006.01)

(52) U.S. Cl.
CPC ..... *B01L 3/502* (2013.01); *B01L 2200/10* (2013.01); *B01L 2200/16* (2013.01);
(Continued)

(58) Field of Classification Search
CPC .... B01L 3/502; B01L 3/502738; B01L 3/527; B01L 2400/06; B01L 2200/10;
(Continued)

(56) References Cited

U.S. PATENT DOCUMENTS 5,882,903 A * 3/1999 Andrevski ..... B01L 3/502 422/50
9,174,182 B2 11/2015 Wimberger-Friedl
(Continued)

FOREIGN PATENT DOCUMENTS

EP 2181333 B1 5/2012
WO WO0240874 A1 5/2002
(Continued)

*Primary Examiner* — Dennis White

(57) ABSTRACT

The invention relates to a fluidic system comprising at least one bead chamber (311) containing a lyophilized reagent (LB) and a reaction chamber in a cartridge. In one embodiment, a series of bead chambers with different lyophilized reagents may be provided such that sample fluid can sequentially pass through them. In another embodiment, bead chambers may be located on a movable carrier, for example a rotating carousel, from which they may selectively be connected to a reaction chamber in a cartridge. In still another embodiment, the bead chamber (311) may comprise at least one flexible wall (FW) allowing for a minimization of dead volume associated with the extraction of lyophilized reagent (LB).

14 Claims, 8 Drawing Sheets

(52) U.S. Cl.
CPC . *B01L 2300/123* (2013.01); *B01L 2400/0487* (2013.01); *B01L 2400/06* (2013.01)

(58) Field of Classification Search
CPC ..... B01L 2400/0487; B01L 2200/0647; B01L 2200/16; B01L 2300/123
See application file for complete search history.

(56) References Cited

U.S. PATENT DOCUMENTS

| | | | | |
|---|---|---|---|---|
| 2004/0037739 | A1 | 2/2004 | McNeely | |
| 2004/0171170 | A1 | 9/2004 | Sandell | |
| 2006/0166233 | A1 | 7/2006 | Wu | |
| 2007/0031283 | A1 | 2/2007 | Davis | |
| 2007/0183935 | A1* | 8/2007 | Clemmens ..... | B01F 11/0071 422/400 |
| 2012/0177543 | A1* | 7/2012 | Battrell ..... | B01F 11/0071 422/187 |
| 2012/0294767 | A1 | 11/2012 | Viola | |
| 2012/0329082 | A1 | 12/2012 | Viola | |

FOREIGN PATENT DOCUMENTS

| | | | |
|---|---|---|---|
| WO | WO03015923 | A1 | 2/2003 |
| WO | WO2007064635 | A1 | 6/2007 |
| WO | WO2007134191 | A1 | 11/2007 |
| WO | WO2008055915 | A2 | 5/2008 |
| WO | WO2008083446 | A1 | 7/2008 |
| WO | WO2008157801 | A2 | 12/2008 |
| WO | WO2012018741 | A2 | 2/2012 |

* cited by examiner

FLUIDIC SYSTEM FOR PROCESSING A SAMPLE FLUID

FIELD OF THE INVENTION

The invention relates to a fluidic system for processing sample fluid, for example fluid of a biological specimen that shall be subjected to an assay.

BACKGROUND OF THE INVENTION

The US 2012/177543 A1 discloses a device in which diaphragm pump members are used to inject, exchange and/or mix fluids in a chamber on a microscope slide.

The WO 2008/157801 A2 discloses a receptacle having a plurality of interconnected chambers separating liquid from dried reagents. In some embodiments, the chambers may have flexible portions on which a compressive force can be exerted.

SUMMARY OF THE INVENTION

In view of this background it would be desirable to have means that allow for an accurate and easy processing of small amounts of sample fluid.

This object is addressed by a fluidic system according to claims 1, 3, and 4 and a method according to claim 2. Preferred embodiments are disclosed in the dependent claims.

The fluidic system according to a basic embodiment of the invention serves to process sample fluid, e.g. a biological specimen in which the presence of particular substances such as nucleic acids or proteins shall be detected. The fluidic system comprises the following components:

- A cartridge with at least one reaction chamber in which processing of the sample fluid can take place.
- At least one chamber comprising a solid reagent that can selectively be added to the sample fluid. Because the solid reagent will typically have the configuration of a bead, said chamber will in the following be called "bead chamber" or "bead storage chamber".

The term "cartridge" shall denote an exchangeable element or unit in which a sample can be provided and processed. The cartridge will usually be a disposable component which is generally used only once for a single sample. Moreover, the bead chamber may be located in the cartridge or in a separate component.

It should be noted that the bead chamber(s) and the reaction chamber(s) may optionally overlap and/or be identical. The bead chambers can particularly be designed and used as reaction chambers, too, in which reactions between the reagent and the sample fluid take place.

A method according to a basic embodiment of the present invention serves for adding reagent to a sample fluid in a fluidic system. It comprises the following steps, which may be executed in the listed or any other appropriate order:

a) Storing the solid reagent in a "bead chamber" of the fluidic system.

b) Pumping liquid into said bead chamber to dissolve the reagent.

c) Pumping the liquid with the dissolved reagent into a "reaction chamber" of the fluidic system.

The method may particularly be executed in a fluidic system described above. In general, explanations provided for embodiments of the fluidic system are analogously valid for the method, too, and vice versa.

The liquid that is pumped in step b) into the bead chamber is preferably taken from the reaction chamber. In step c), this liquid is therefore pumped back, preferably along the same route via which it reached the bead chamber, thus minimizing the amount of lost fluid. The liquid will typically be the sample fluid itself.

Pumping of the liquid into the bead chamber (step b) is typically done by applying a pressure to the liquid. Preferably, the bead chamber is temporarily expanded during this step. Similarly, pumping the liquid into the reaction chamber is typically done by using vacuum during which the bead chamber retracts.

The dissolution of the solid reagent (typically a bead) is preferably followed by homogenization.

The solid reagent that is used in the fluidic system and the method is preferably a material (particularly a bead) out of which reagent(s) can diffuse and dissolve upon contact with liquid. Most preferably, the solid reagent is lyophilized, especially a lyophilized bead. The reagents may for example comprise enzymes such as polymerases, proteinase K, or reverse transcriptases, or oligonucleotides (labeled or unlabeled), nucleotides, antibodies (labeled or unlabeled), labeled oligopools, e.g. for FISH, polymerases and ligases for PLA, or salts and the like.

The fluidic device and the method have the advantage that, by providing a solid reagent in a bead chamber, the addition of the respective reagent to the sample fluid is facilitated. In particular, the solid reagent can be stored in advance in the fluidic system without a need to transfer it from some external storage over a distance into the reaction chamber of the cartridge.

According to one particular aspect, an embodiment of the invention comprises a fluidic system with a bead chamber that has at least one flexible wall.

The aforementioned flexible wall may preferably have at least one of the following features:

(i) It can bulge outward, increasing the volume of the bead chamber and thus sucking fluid in, when a reduced pressure (vacuum) is applied to its outside.

(ii) It is pre-stretched.

In order to allow for an outward bulging of the flexible wall, sufficient space has to be provided adjacent to said wall. If the fluidic device is for example designed to be positioned on a flat table (e.g. of a microscope) with the flexible wall facing said table, a hole may be provided in the table adjacent to the flexible wall. Moreover, it should be noted that the term "reduced pressure" means that this pressure, which is applied to the outside of the flexible wall in order to bulge it outward, will typically be lower than the pressure prevailing at the inside of said flexible wall. The outside pressure will therefore sometimes also be referred to as "(partial) vacuum" in the following.

The flexible wall may for example be a wall that can expand when fluid is pumped into the bead chamber by the use of pressure, and then go back to its original position or retract even further upon applying vacuum. Additionally or alternatively, the flexible wall can be a pre-stretched wall (e.g. covering a bead) that can retract upon applying vacuum after mixing of the reagent with liquid or due to recoil of the stretched wall by elastic forces in the material. In all cases the use of a flexible wall leads to a reduction of the effective dead volume in the system as compared to an embodiment with only stiff walls. A combination of pre-stretching and further expansion when fluid is pumped in is beneficial as well.

The flexible wall may for example be realized by some membrane or foil, particularly a rubber foil. It can be used to accommodate different volumes in the bead chamber without losing too much sample material in dead volumes.

In a preferred embodiment the flexible wall is made of an elastomeric material with a Young's modulus in the range of 1 MPa to 400 MPa at room temperature. It should have a high resilience and rupture strength. Next to cross-linked materials, like rubber, silicone or polyurethane also thermoplastic materials can be used, in particular so-called thermoplastic elastomers (TPE). Such TPE can be of olefin, ester, ether or urethane basis and can be amorphous or semi-crystalline. A preferred material class comprises TPE on olefin basis due to the high chemical inertness and biocompatibility.

The bead chamber may optionally comprise two flexible walls disposed opposite to each other.

The bead chamber can be designed such that upon retraction of the flexible wall (spontaneous or be applying pressure) the resulting dead volume of the bead chamber after the reagent is dissolved is practically zero.

In order to move the flexible wall actively and controllably, the fluidic system may preferably comprise a pressure controller for controlling pressure on the outside of the flexible wall. A reduced pressure at the outside of the flexible wall may for example be used to bulge said wall outward, increasing the volume of the bead chamber and thus sucking fluid in.

In another embodiment, the bead chamber may comprise at least two compartments, one compartment accommodating solid reagent and the other compartment comprising a flexible wall. This allows for the separate and individually optimal arrangement of the solid reagent and the flexible wall, respectively, wherein said compartments are connected and in fluid communication by a channel or the like. Such an embodiment can facilitate the external actuation of the flexible wall.

According to another particular aspect, an embodiment of the invention comprises a fluidic system with two or more bead chambers that are located on a movable carrier such that any of these bead chambers can selectively be coupled to the reaction chamber. Preferably, each of said bead chambers contains a different solid reagent. These solid reagents can then selectively and sequentially be added to a sample fluid in the reaction chamber. It should be noted that movability of the carrier is to be understood relative to the reaction chamber. With respect to the environment, the carrier, the reaction chamber, or both might actually be moving.

An important advantage of this embodiment is that (on the side of the reaction chamber) always the same passage or channel can be used to transfer solid reagent from the bead chamber to the reaction chamber. Even if a large number of solid reagents have to be added to the sample fluid, there will hence maximally be a single loss of fluid in the transfer passage.

The carrier may be movable in any possible way and direction such that a desired coupling of its bead chambers to the reaction chamber can be achieved. In a preferred embodiment, the carrier is designed as a rotatable carousel. The bead chambers of this carousel may be arranged circumferentially at a radius from the axis of rotation such that by rotation of the carousel will sequentially position each bead chamber in connection to a stationary reaction chamber.

The carrier may preferably comprise at least one "blind" position. Connecting this blind position to the reaction chamber may then be used to interrupt the exchange of material between the bead chamber and the reaction chamber.

The carrier may optionally be an integrated part of the fluidic system (i.e. be permanently attached to the cartridge while being movable relative thereto in a limited range). In a preferred embodiment, the carrier is however designed to be initially separate from the cartridge but attachable to the cartridge. This attachment may for example take place immediately before an assay is executed in the cartridge, allowing for a storage of the carrier with its solid reagents under optimal conditions (e.g. in a refrigerator) prior to use. The attachment may be reversible or not. In a preferred embodiment, the cartridge and the carrier are disposable items used for one examination only.

In a further development of the embodiment with the carrier, an intermediate element may be disposed between the carrier and the cartridge that is movable relative to the carrier and/or the cartridge. The movable intermediate element may for example be a plate comprising a channel. Only if this channel is aligned to a bead chamber of the carrier and to the reaction chamber in the cartridge, and exchange of material between said bead chamber and reaction chamber is possible.

According to another particular aspect, an embodiment of the invention comprises a fluidic system with two or more bead chambers that are fluidically connected in series.

This means that a fluid such as the sample fluid can sequentially flow though these bead chambers. The reagents of the solid reagents that are provided in the bead chambers will hence sequentially and in a well-controlled manner be taken up by said fluid.

The bead chambers can particularly be designed and used as reaction chambers, too, in which reactions between the solid reagent and the sample fluid take place.

According to a further development of the aforementioned embodiment, at least two consecutive bead chambers of the series are separated from each other by a valve. Preferably, all consecutive bead chambers of the series are separated by an associated valve. By opening and closing these valves, the flow of (sample) fluid through the bead chambers can be controlled.

In order to allow for the inflow of fluid into a bead chamber (with rigid walls) the fluid outlet of which is still closed, said chamber may optionally be connected to a vent port. Each bead chamber of the series of the chambers may have an individual vent. Additionally or alternatively, some (or even all) bead chambers of the series of the chambers may be connected to a common vent port.

In the following, various further developments of the invention will be explained that can be realized in combination with any of the embodiments described above.

Thus the fluidic system may have two or more bead chambers that contain different solid reagents (i.e. the reagent in a first chamber is different from the reagent in a second chamber). These solid reagents can then be taken from the associated bead chambers and be added to the sample fluid at appropriate points in time according to the assay that shall be executed with the sample.

In order to protect the solid reagent in the bead chamber before its use, the bead chamber may optionally be separated from the reaction chamber by a destructible seal. Said seal may for instance be a foil covering an outlet of the bead chamber until it is disrupted, for example mechanically, by heat, and/or by radiation. This embodiment is particularly advantageous if liquid reagents are integrated as well, or if bead chambers are located on a movable carrier that is attached to the cartridge by hand before the start of the assay. In general, the bead chamber(s) will typically be protected against humidity by the packaging that is provided for the cartridge anyway.

In another embodiment, the bead chamber is connected to a vent port to which its contents, for example the gas surrounding the solid reagent, can be vented allowing for the entrance of another fluid into the bead chamber. The connection between the bead chamber and the vent port preferably comprises a valve that can selectively be opened and closed to control venting.

The fluidic system may optionally comprise at least one pressure source for selectively applying a pressure to some part of the fluidic system such as the reaction chamber and/or to the bead chamber. The pressure may particularly be an overpressure or a reduced pressure with respect to the ambient pressure of the fluidic system. The pressure may for example act on a fluid in the reaction chamber, driving it to the bead chamber or pulling it away from there. Moreover, the pressure source may be used to generate pressurized gas (e.g. air) that can be introduced into the fluidic system in order to propel fluid.

In another embodiment, the fluidic system comprises a pressure source for selectively applying a pressure to a flexible wall of a bead chamber, particularly to the outside of this flexible wall (i.e. the side that does not face the bead chamber). The pressure may then for example act on a movable membrane or wall such that (sample) material on the other side of the membrane or wall can controllably be moved by applying an appropriate pressure.

In order to control the flow of fluid inside the fluidic system, at least a portion of the internal surface of the fluidic system may be hydrophobic, particularly the inner surface of the bead chamber(s).

In another embodiment of the invention, the fluidic system may have an actuator for providing a controllable interaction with the sample fluid. Many processing procedures require for example a control of the temperature of the sample fluid. Accordingly, the actuator may optionally be or comprise a temperature controller for heating and/or cooling the sample fluid. The temperature controller may for example be realized by a Peltier element. Other embodiments may comprise an actuator for mechanically manipulating the sample fluid, for example a piezo element that can facilitate mixing of the fluid with the reagent. In general, the actuator may be designed for applying energy such as electromagnetic radiation, heat and/or ultrasound to the sample.

BRIEF DESCRIPTION OF THE DRAWINGS

These and other aspects of the invention will be apparent from and elucidated with reference to the embodiments described hereinafter.

In the drawings.

Like reference numbers or numbers differing by integer multiples of 100 refer in the Figures to identical or similar components.

DETAILED DESCRIPTION OF EMBODIMENTS

Figure 1:
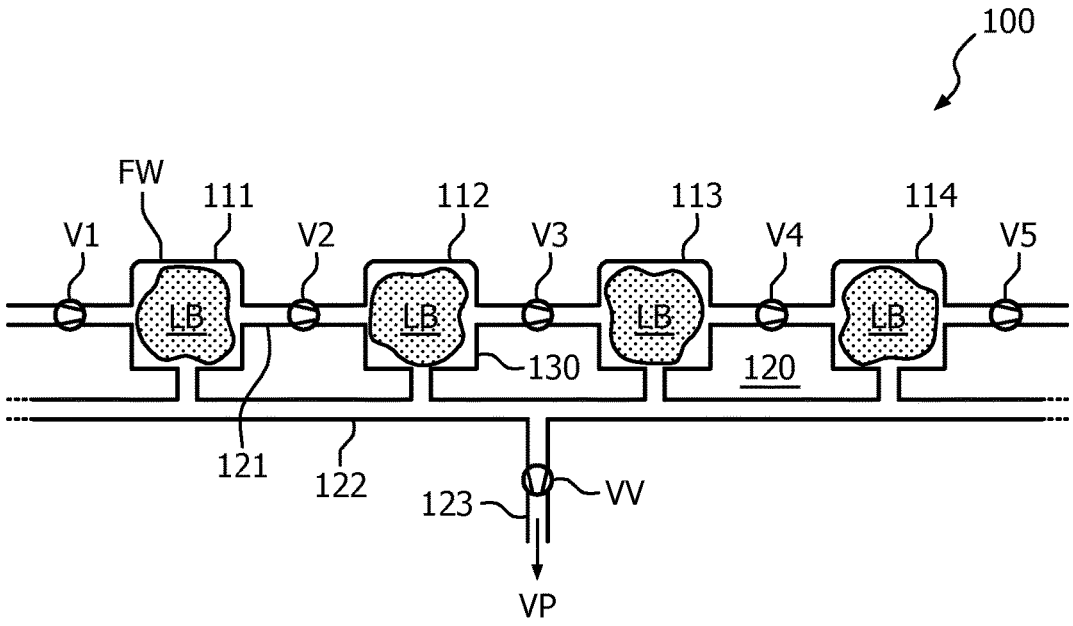
FIG. 1 schematically shows a fluidic system in which bead-and-reaction chambers are connected in series.

For fully automated, integrated diagnostics devices or cartridges that carry out assays, like PCR and sequencing, many reagents need to be available in the cartridges. Biological reagents like enzymes may be freeze-dried ("lyophilized") during which a solid, porous substance is obtained in the form of a bead (lyophilized bead). Such lyophilized beads allow for easy handling and storage at higher temperatures than liquid solutions and for a long shelf life compared to liquid formulations. Additionally, one bead can contain the amount of enzyme for a single reaction enabling accurate dosing. The beads can either be stored on a cartridge or they can be first stored separately at storage conditions (e.g. refrigerated) and prior to use inserted in the cartridge. Prior to the biological reaction, liquid may be pumped to the beads to dissolve them after which the enzymatic reaction can be started.

One challenge for integration of lyophilized beads is the manipulation, dissolution and homogenization thereof and especially when using small reaction volumes (needed for PCR for example). Lyophilized beads are very fragile and light, which makes manual manipulation risky. Due to their porous nature the beads occupy a large volume. When integrated in a cartridge this leads to large dead volumes increasing the total volume of the system and the amount of other reagents required. Pumping to and from a lyophilized bead to a reaction chamber leads to a loss in reaction volume and to a certain dead volume. With the generally low reaction volumes used, the dead volume should preferably be minimized.

Furthermore, a challenge of cartridge and reagent integration is the compatibility of wet and dry reagents: dry reagents should preferably be stored at low relative humidity, whereas wet reagents stored in plastic containers should preferably be stored under ambient conditions (since storing containers filled with wet reagents at low relative humidity results in evaporation losses). The concept as disclosed here allows for beads to be stored either in- or outside of cartridges in such a way that they can be stored in a dry environment, separated from the wet reagents and can be clicked onto the cartridge prior to the start of the assay.

Additionally, several biological processes require multiple subsequent reaction steps. Preferably before adding the enzymes of the next reaction step, the liquid should be cooled to e.g. to about 0° C.-20° C. In order to speed up, active cooling is preferred with e.g. a Peltier element. Then after dissolving the bead, the liquid should be heated up again. This is often repeated a number of times, meaning that a lot of time is lost on heating and cooling of the liquid.

Serial arrangement of Combined Bead and Reaction Chambers

In order to address the above issues, one embodiment of the invention envisions multiple larger bead-and-reaction chambers, each containing a bead. These chambers can be separated from each other by a single valve. By pumping a sample liquid from one bead-and-reaction chamber to the other, the beads will dissolve and the reaction can proceed. The dead volume only consists of the amount of liquid that remains in the previous bead-and-reaction chamber, and the single valve in between two chambers.

FIG. 1 schematically illustrates an embodiment of a corresponding fluidic system 100 with a series of the bead-and-reaction chambers 111, 112, 113, 114, . . . (or shortly "bead chambers") that serve simultaneously as bead chambers and reaction chambers (for this reason, they may also be designated with reference sign "130"). Each of these bead chambers comprises a lyophilized bead LB, wherein the beads of different bead chambers preferably differ in their chemical contents. The bead chambers are separated from each other by individual valves V1, V2, V3, V4, . . . that can individually be controlled. Moreover, each bead chamber is connected to a common vent port VP, wherein the opening and closing of this vent port can be controlled by an associated valve VV.

Underneath the bead-and-reaction chambers 111-114, individual heating elements can be arranged to allow for a temperature control. A liquid sample may be pumped, for example with a syringe or a plunger, into the first chamber 111 on the left. When the liquid arrives in the chamber, the associated lyophilized bead LB will dissolve, and the reaction can be started by turning the heater underneath the chamber on.

After finalization of the reaction, the valve V1 in between the first and the second chamber 111, 112 can open as well as the venting valve VV for the respective chamber 112, and the liquid can proceed towards the next bead-and-reaction chamber 112, where the next bead LB is heated up and the next reaction can proceed. This process can be repeated until all reactions have been performed.

Cooling of the sample liquid is done during pumping and arriving in the bead-and-reaction chamber, since the heat capacity of the channels, valves and chamber itself is higher than that of the liquid. Therefore, no Peltier is needed but only a heater can be expected to suffice.

The dead volume of the fluidic system 100 is only limited to the volume in the valve in between two bead-and-reaction chambers and the volume that remains behind in the bead-and-reaction chamber.

The walls of the bead chambers 111-114 may be rigid. In a preferred embodiment, at least one wall FW of the bead chambers may however also be flexible. Each bead chamber 111-114 may for example be bordered by a flexible foil. After dissolving the lyophilized bead LB and performing the reaction, the liquid can be pumped to the next bead storage chamber. Because of the flexible wall FW, the dead volume remaining behind can be minimized by retracting the flexible wall.

In summary, a solution has been described how multiple lyophilized beads can be integrated in a cartridge. Lyophilized beads are generally large and therefore they occupy a large volume. As a result, to pump liquid into a chamber where a bead is stored, and then back, implies a relatively large dead volume. Instead of a single reaction chamber, multiple bead-and-reaction chambers are therefore used. Each chamber can contain one or more lyophilized beads. A valve is located in between two chambers, thereby fluidically separating them. After finalization of one reaction, liquid is pumped towards the next chamber, where the bead present is being dissolved, and then the next reaction can start. Due to the fact that the liquid will cool quite fast when pumped from one chamber to the other, there is no need for active cooling underneath the reaction chambers, which lowers the overall times needed. Venting structures are used to remove the air present in the chambers.

Separate Bead and Reaction Chambers

Figure 2:
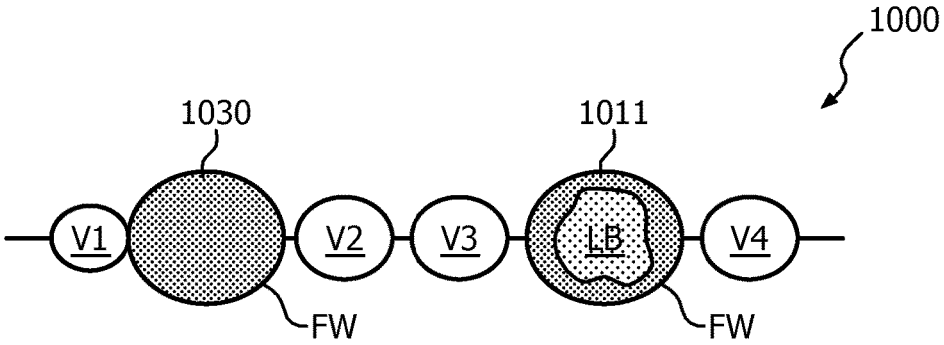
FIG. 2 schematically shows a fluidic system with a separate reaction chamber and bead chamber.

FIG. 2 shows a top view of a fluidic system 1000 in a cartridge 1020 comprising a bead chamber 1011 and a reaction chamber 1030 that are connected to each other. The reaction chamber 1030 typically contains about 100-200 μl of liquid. One or more solid (e.g. lyophilized) beads LB can be stored in the bead storage chamber 1011. The reaction chamber has a venting valve V1, which is opened during pumping of the liquids. In between the reaction chamber and the bead storage chamber two valves V2 and V3 are located (this can be reduced to a single valve as well). A further valve V4 that is used to pump the liquid from the reaction chamber 1030 is located at the right.

Figure 3:
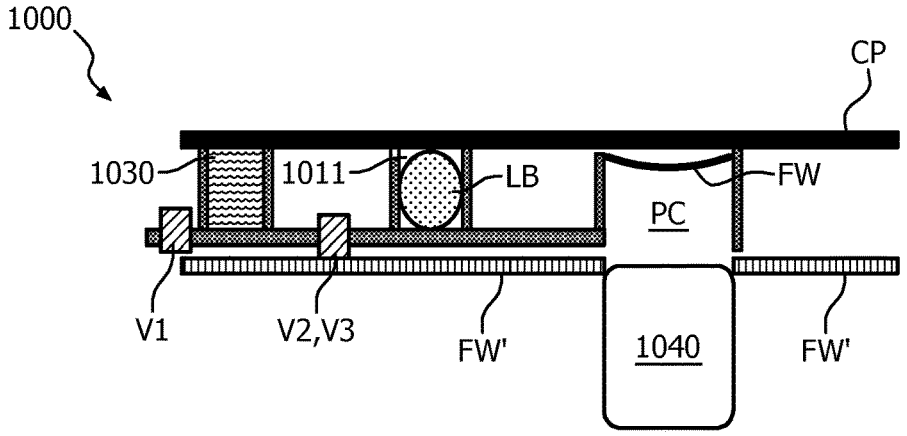
FIG. 3 schematically shows a side view of the fluidic system of FIG. 2.
Figure 4:
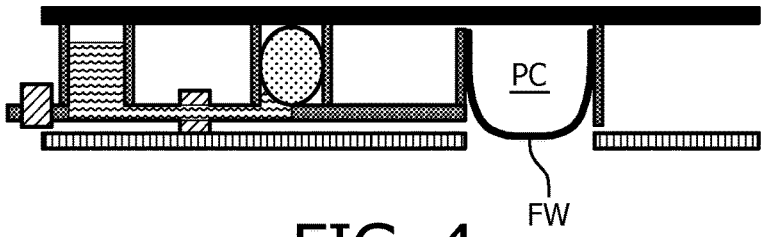
FIG. 4 schematically shows the fluidic system of FIG. 3 after actuation of a pump.

A simplified side view of the fluidic system 1000 is given in FIGS. 3 and 4. For simplifying reasons, regular closed valves used to close off liquid flow are only represented as a rectangle. In FIG. 3, the reaction chamber 1030 is filled with a sample fluid. A flexible foil FW' is located underneath the whole cartridge 1020, except for a pumping chamber PC. The pumping chamber is an open connection, covered on the top by another flexible foil FW. A cover plate CP consists of this flexible foil FW as well as a more solid layer for covering the other chambers and providing support to the flexible foil. After filling the chambers, this cover structure is put onto the cartridge.

In the default situation, the valves V2+V3 in between the reaction chamber 1030 and the bead chamber 1011 are closed (no liquid flow). The venting valve V1 is closed as well. Onto the pumping chamber PC, pressurized air is put, which means that the over-pressure makes sure that the flexible foil FW is flat, as given in FIG. 3. No liquid will thus flow from the reaction chamber to the bead.

Upon actuation of a pump 1040 (only schematically indicated in FIG. 3), the upper flexible foil FW will bend inwards. This is shown in FIG. 4. An under-pressure will be created in the pump chamber PC. Upon opening the valves V2+V3, the liquid will be sucked into the channels, leading towards the bead chamber 1011. Upon arriving in the bead chamber, the bead will be dissolved immediately. After dissolution of the bead, pressure is again put onto the flexible foil FW in the pump chamber, over-pressure will be generated, pushing the liquid that contains the dissolved bead back into the reaction chamber. As in principle only a single valve needs to be in between the reaction chamber and bead chamber, this leads to very low amounts of dead volume.

Initially, the flexible foil FW may preferably be pre-stretched by actuation of the pumping chamber PC a number of times (with valves V2+V3 closed to prevent liquid flow). Pre-stretching of the foil can be helpful to have a larger pumping stroke or to have a more reproducible pump stroke.

Dead volume can be further reduced by minimizing the channel length, making the valve(s) smaller, and/or using only one instead of two valves.

The pump stroke needs to be big enough to suck the liquid from the reaction chamber into the bead storage chamber, but the flow should preferably go not beyond that point. This means that there is an optimum in the pumping stroke. There are at least two variables that influence the pumping stroke, which are the pumping chamber diameter and the diameter of the flexible foil on top of it.

Successful experiments were executed with a 3 mm diameter of the pumping chamber in combination with a 6 mm foil diameter. A larger diameter of the foil means that the foil can be bent better which leads to a somewhat larger pumping stroke. It should be noted in this context that the volumes of both the pump strokes as well as the reaction chamber are important parameters to optimize because these volumes (as well as their ratio) determines the amount of liquid that is being transported from the reaction chamber to the bead chamber, wherein a too high pump stroke may result in flooding of the bead chamber. The experiments showed that the concept works with a relatively small dead volume. The cartridge itself is easy to manufacture. Normal cartridge designs were made, only a top plate needs to be put on top of it, but this needs to be done in the final design anyway to cover reaction chambers etc.

Fluidic System with Carousel

Figure 5:
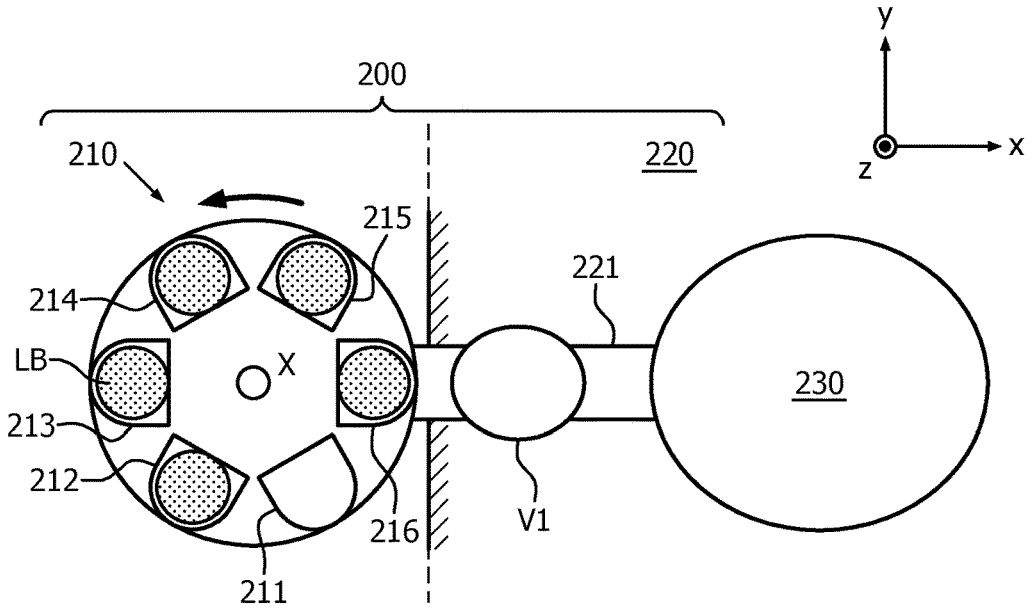
FIG. 5 schematically shows a top view onto a fluidic system comprising bead chambers in a carousel.

FIG. 5 schematically shows a top view onto another embodiment of a fluidic system 200, said system comprising a cartridge 220 and a carousel 210 which is rotatable about a rotation axis X. The cartridge 220 comprises a reaction chamber 230 that is connected to the outside via a transfer channel 221 with a valve V1. At the outside, said transfer channel 221 contacts the carousel 210 (if it is in place). In particular, each of the bead chambers 211, 212, . . . 216 that are distributed along the circumference of the carousel 210 can (fluidically) be connected to the transfer channel if it is rotated to the appropriate position.

The carousel 210 contains one or more reagents in the form of lyophilized beads LB. The carousel 210 can be attached to the cartridge 220 for carrying out a biological assay. By rotation of the carousel, a certain bead LB can be selected and a fluidic contact between the bead and the fluid inside the cartridge can be established. Depending on the embodiment, a separate seal can optionally be present that has to be broken to establish physical contact between the fluid of the cartridge and the bead LB. When fluidic contact is made with a buffer, the reagents in the bead will dissolve and the (enzymatic) reaction can be started.

The carousel 210 can either be placed on top of the cartridge 220 prior to running an experiment, or the carousel can already be present on top of the cartridge. The carousel is preferably pre-filled with different beads LB during production, so no or limited (like clicking of the bead carousel on top of the cartridge) handling is needed by the user.

The described concept operates with a low dead volume due to two facts: Firstly, by rotating the different beads LB can be accessed through the same fluidic channel 221. Secondly, only very local physical contact is required between the bead LB and the buffer to dissolve the bead by capillary forces, without the need to fill the bead chamber that contains the bead completely. This enables using several different beads in a small total volume of about 100-200 μl.

The described embodiment can be modified in many ways. One fundamental element is the bead carousel 210, visualized in a top view in FIG. 5. In this example, there are five bead chambers 212-216 each containing one lyophilized bead LB (though this is not limited; in principle a bead chamber can contain multiple beads). One chamber 211 is either empty, or is totally closed. If this "blind chamber" 211 contacts the transfer channel 221 of the cartridge 220, no fluidic connection is possible. Then the bead carousel is turned, making fluidic connection between one of the beads LB (e.g. as shown in bead chamber 216) and the reaction mixture in the transfer channel 221 possible. When liquid is pumped to the bead storage chamber 216, the reagents enclosed in the bead LB will dissolve and the reaction can start. This procedure can be repeated a number of times, each time making fluidic connection to another bead. In these steps, the same transfer channel 221 is used for pumping the liquid, thereby limiting dead volume. The bead chambers can optionally be bordered by a flexible wall.

One or more valve(s) V1 may be provided in the transfer channel 221 in between the bead carousel and the reaction chamber for selectively closing this channel. If the blind chamber 211 contacts the transfer channel, there is no fluidic contact possible between the reaction chamber and one of the beads. Upon a slight rotation of the bead carousel and after opening the valve V1 in between the bead and the reaction chamber, liquid can be pumped to the bead storage chamber and the bead will dissolve. Upon dissolution, the liquid containing the dissolved bead can be pumped back.

In another embodiment, a bead carousel may be located above or partly above (with respect to gravity) the reaction chamber of the cartridge. An intermediate layer (not shown) with e.g. one hole in it may be used to make the connection between the bead chamber(s) and the reaction chamber. By rotation of this intermediate layer, the hole can be located directly underneath a bead and the bead will fall into the liquid in the reaction chamber underneath. If needed, small amounts of pressurized air can be used to direct the bead towards the reaction chamber.

In the example shown the liquid tight separation of the beads once a bead is accessed may be at danger, depending on the accuracy of the fit between the carousel and the cartridge and the hydrophilicity of the surfaces. The risk of cross-contamination can be controlled by making the surfaces hydrophobic and by controlling the gap between the carousel and the cartridge within tight tolerances.

In still another embodiment, a completely closed and sealed bead storage can be achieved by using a sealing foil to cover the bead chambers that contain the beads. After rotation of the carousel in the desired position the seal can be broken, for instance by a beam of (e.g. laser-) radiation that melts or ruptures the film in the position that allows fluid contact with the cartridge. Additionally or alternatively other means for establishing a connection between a bead storage chamber and the reaction chamber are applicable, e.g. mechanical means.

Figure 6:
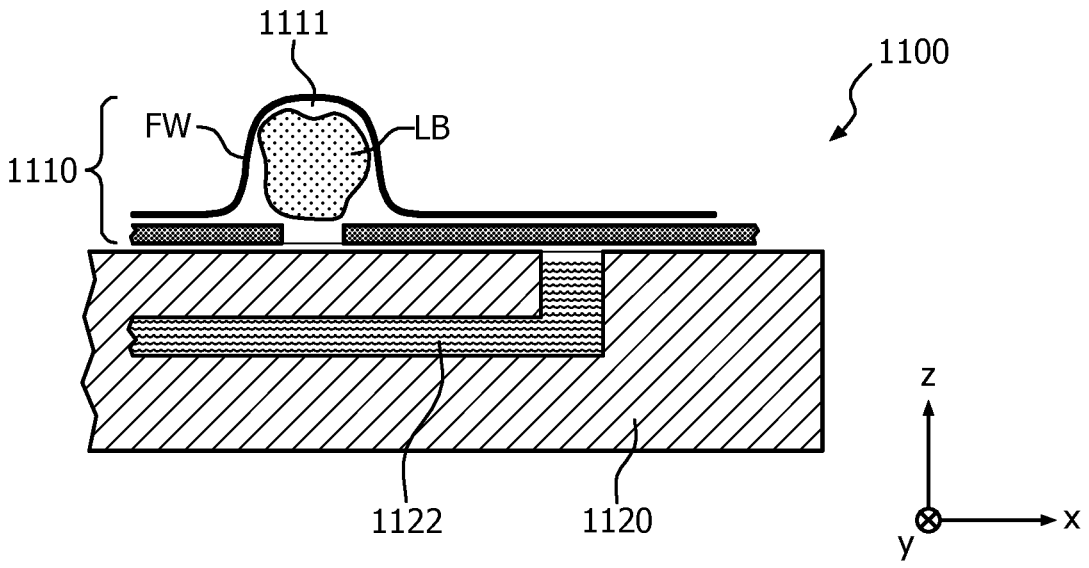
FIG. 6 schematically shows a sectional view through a fluidic system with a movable carrier on a cartridge.
Figure 7:
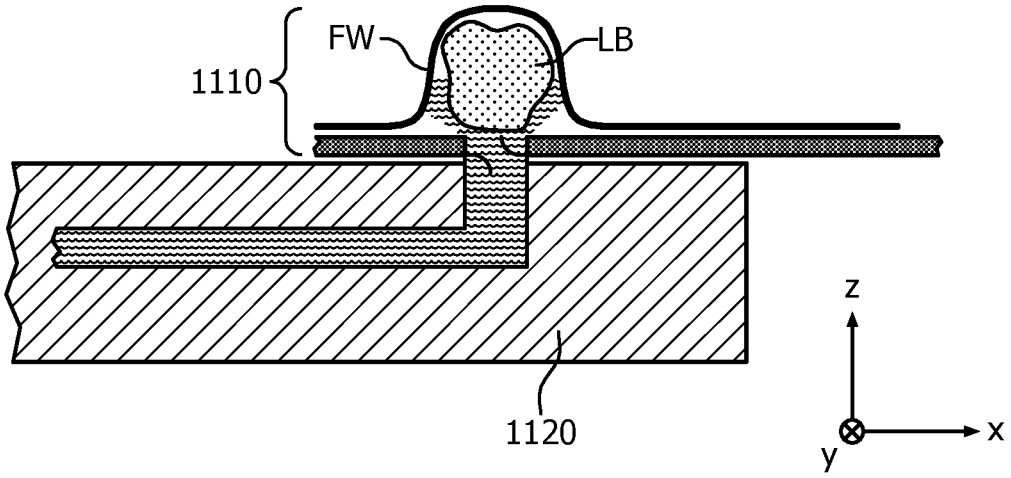
FIG. 7 shows the fluidic system of FIG. 6 after alignment of the carrier's outlet with the cartridge's inlet and rupture of a seal.
Figure 8:
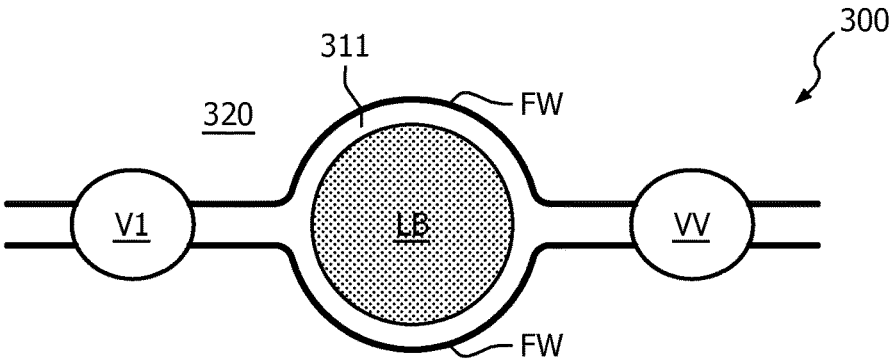
FIG. 8 schematically shows a top view of a bead chamber with flexible walls containing a lyophilized bead.
Figure 9:
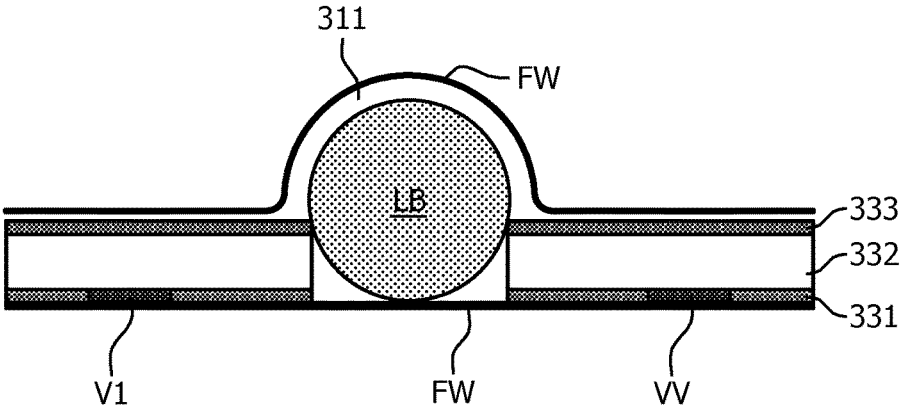
FIG. 9 shows a side view of the bead chamber of FIG. 8.

An alternative embodiment of a fluidic system 1100 with a cartridge 1120 and a carrier 1110 that can be moved relative to the cartridge is shown in FIGS. 6 and 7. The carrier 1110 will in the following be assumed to be a rotatable carousel, though it may in general be movable by translation and/or rotation.

A lyophilized bead LB in a bead chamber 1111 of the carousel is covered with a flexible foil FW. In FIG. 6, there is no fluidic connection between the reaction chamber 1130 in the cartridge and the lyophilized bead LB. Upon rotation of the carousel 1110 (of which only a single chamber is drawn), a fluidic connection will be made from the reaction chamber to the bead. As shown in FIG. 7, the liquid can be pumped into the bead chamber (bead can dissolve) and pumped back again, leaving behind only a minimal amount of liquid.

The bead chamber 1111 may initially be sealed by a destructible foil, which is ruptured when the bead shall be accessed (FIG. 7).

In summary, another way of storing and using reagents as lyophilized beads in cartridges has been described according to which the beads are stored in a separate unit, a bead carrier or carousel which allows storage under optimum conditions (e.g. refrigerated and under low relative humidity). A connection can be made between a cartridge and the bead carousel and the reagent can be picked up by making fluidic contact between the microfluidic system of the cartridge and the bead, leading to spontaneous dissolving, and by pumping back to the reaction chamber to homogenization. Then a next reaction can be started by rotation of the bead carousel exposing the next bead. The same microfluidic channel is used for all reagents ensuring minimal dead volume.

Fluidic System with Flexible Walls

An essential feature of another embodiment of the invention is a bead chamber that contains a solid (e.g. lyophilized) bead and that is covered at least on one side with a flexible wall, e.g. a flexible foil. This wall/foil can elastically deform when exposed to over-pressure or vacuum. The deformation can be used to:

- pump liquid into the bead storage chamber and dissolve the bead;
- allow for good homogenization;
- empty the bead storage chamber such that the remaining loss of liquid (the dead volume) is reasonably small.

Accordingly, this embodiment allows for bead storage in a cartridge, dissolving of the beads, homogenization of the beads, limited dead volume, and an easy manufacturing process.

FIGS. 8-11 show schematically a first embodiment in which the above general principles are realized. A lyophilized bead LB is located in a bead chamber 311 of a fluidic system 300 (which may be a part of a cartridge 320). Typical dimensions of the lyophilized bead LB may be about 1 mm to about 10 mm.

The fluidic system 300 comprises a carrier material 322. This carrier comprises a hole at the position of the bead chamber, said hole being covered (from bottom and top) by a flexible wall FW or membrane. A double sided tape 331 and 333 that contains channel structures is disposed on the top side and the bottom side of the carrier material 332, attaching the flexible wall FW to the carrier. Moreover, valve structures to close/open the channels are provided (e.g. in the tape 331 at the bottom of the carrier). In particular, a filling valve V1 is provided through which liquid can controllably enter the bead storage chamber 311, and a venting valve VV that can be (but does not have to be) used for venting.

The flexible wall FW is initially pre-stretched to cover the bead LB.

During storage, the bead LB is fixated in the fluidic system 300. The valves can preferably be normally closed valves but do not necessarily need to be so since the channel dimensions (about 100 μm) are much smaller than the bead dimensions. In this way, the fragile beads are not likely to move or break.

Figure 10:
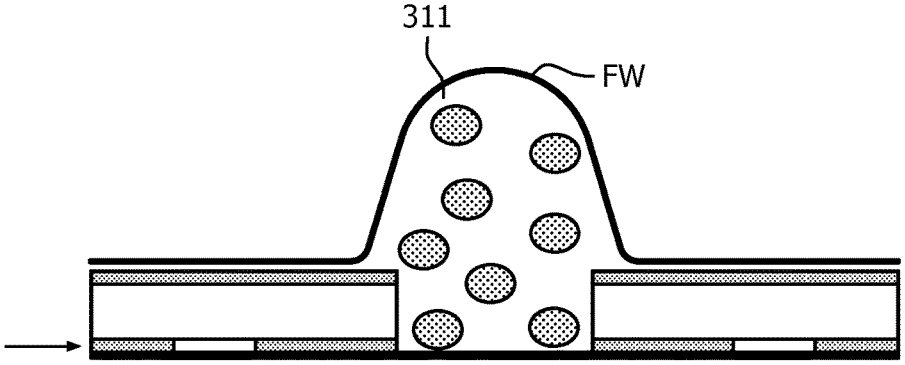
FIG. 10 shows the fluidic system of FIG. 9 during dissolution of the lyophilized bead.

FIG. 10 illustrates the processes that occur when the beads LB need to be dissolved. The filling valve V1 is opened in this case and liquid enters the bead storage chamber 311. The flexible membrane FW expands due to pressure build-up. This allows the lyophilized bead to dissolve and homogenize.

Figure 11:
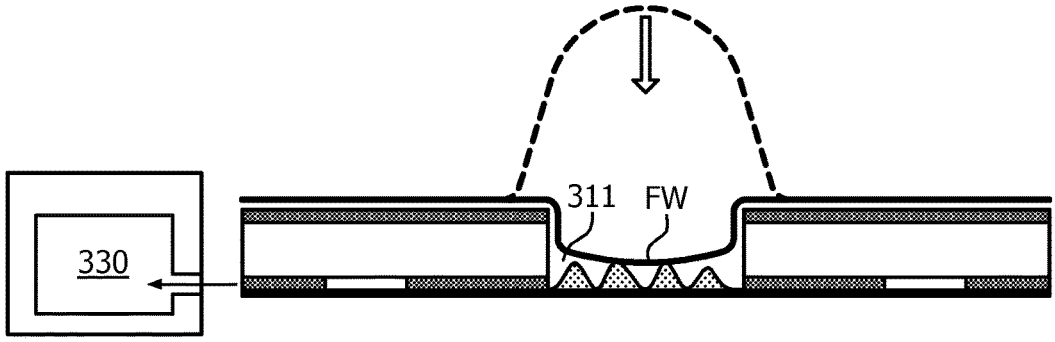
FIG. 11 shows the fluidic system of FIG. 10 after emptying.

FIG. 11 illustrates the subsequent process of removal of the dissolved bead. In order to empty the bead storage chamber 311, in which the bead is now fully homogenized, the liquid flow can be reversed, forwarding liquid with reagents to a reaction chamber 330. The flexible foil FW can retract during this process, leaving behind only a marginal amount of dead volume (much smaller than when a rigid top would be used).

Usually, there will be a small amount of liquid left in the bead storage chamber. As an alternative embodiment to potentially reduce this amount, a venting channel can be used. When first building up over-pressure (e.g. by heating or other means) behind the venting valve VV and then opening the valve, the over-pressure can further be used to help the liquid flow out of the bead storage chamber 311.

Figure 12:
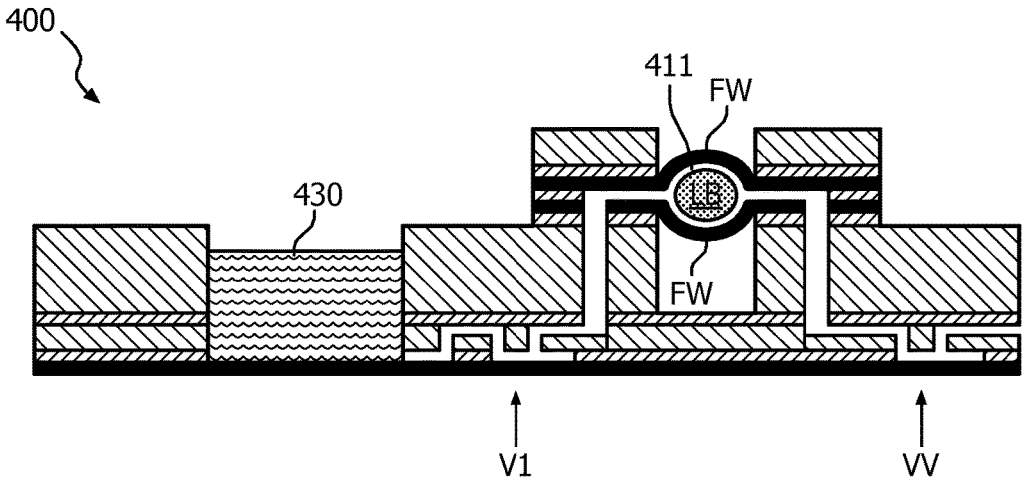
FIG. 12 schematically shows a section through a fluidic system comprising a bead chamber with two opposing flexible walls.

FIG. 12 illustrates an alternative embodiment of a fluidic system 400 in which a flexible foil or membrane FW is used on both sides of a lyophilized bead LB in a bead chamber 411. This embodiment has the potential of a lower dead volume since the bead chamber 411 can be fully retracted when the liquid is pumped out into the reaction chamber 430.

Figure 13:
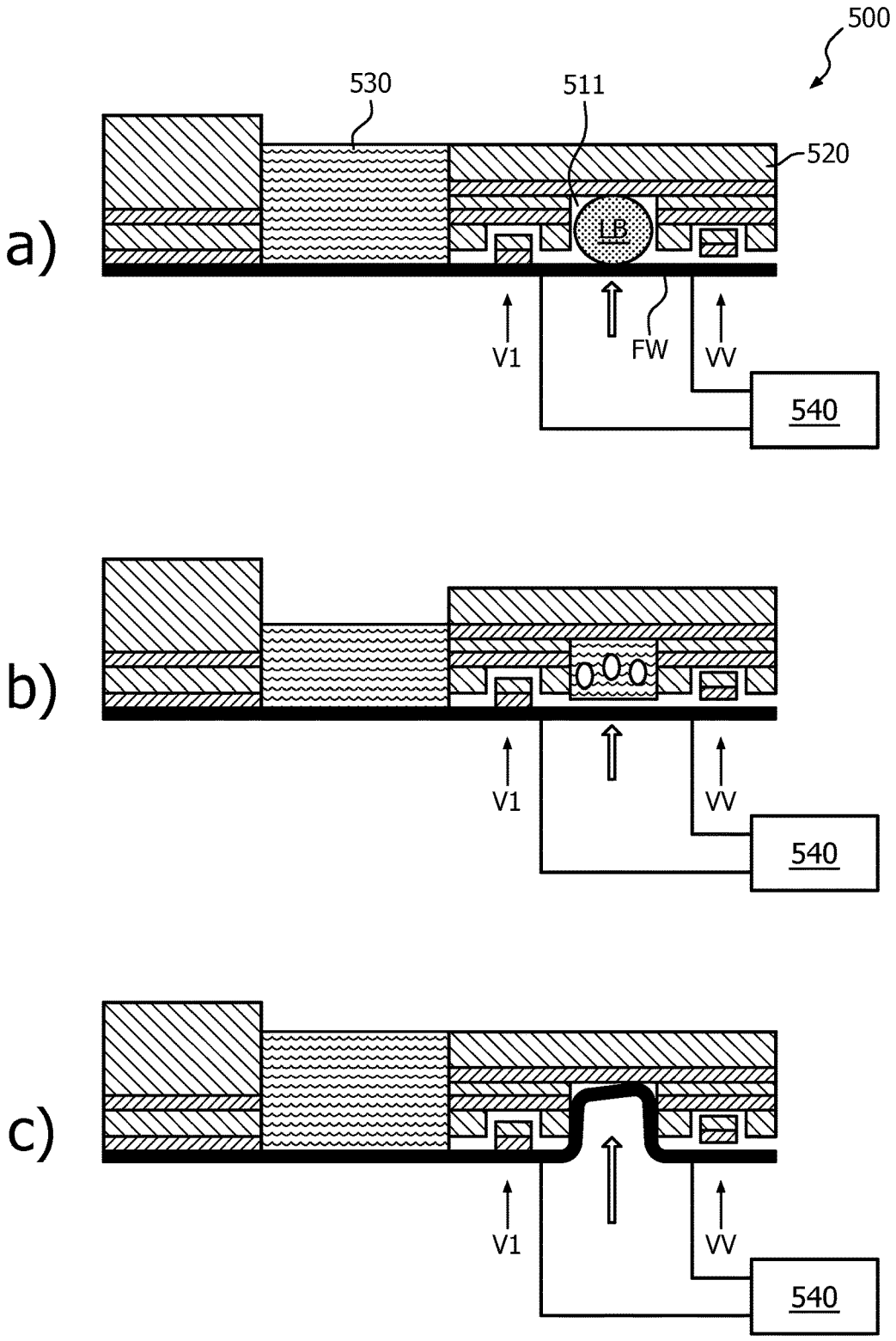
FIG. 13 illustrates the filling of a bead chamber with sample fluid and the expulsion of this fluid after dissolution of the lyophilized reagent.

FIG. 13 illustrates another embodiment of a fluidic system 500 that is a variation of the first embodiment (300). In this example, a flexible foil FW is located at the bottom of a cartridge 520, directly on top of a connection to pressurized air from a pressure source 540 (FIG. 13*a*). During dissolution of the bead LB in the bead chamber 511 and filling of the cartridge, the venting valve VV is opened and the bead can be dissolved (FIG. 13*b*). When the dissolved bead is pumped to the reaction chamber 530, the venting valve VV is closed. The bead chamber 511 is subsequently emptied by pumping and by applying pressurized air from the bottom to the outside of the flexible wall FW (FIG. 13*c*).

As an additional alternative, it is also possible to have a hole above the bead storage chamber. In that case, also vacuum can be connected and by using vacuum, the bead chamber can be filled.

Figure 14:
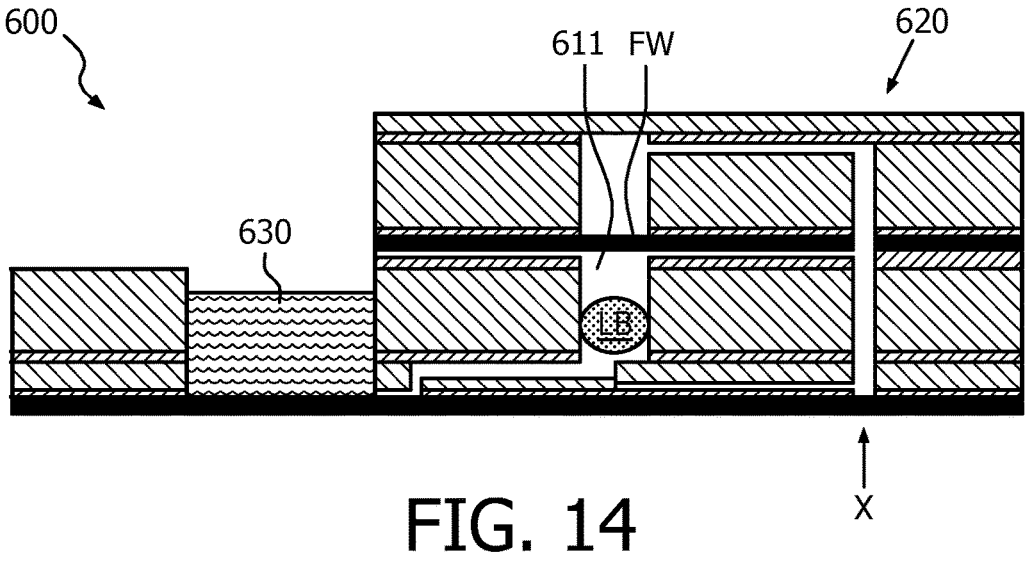
FIG. 14 schematically shows another embodiment of a fluidic system with a bead chamber having a flexible wall.
Figure 15:
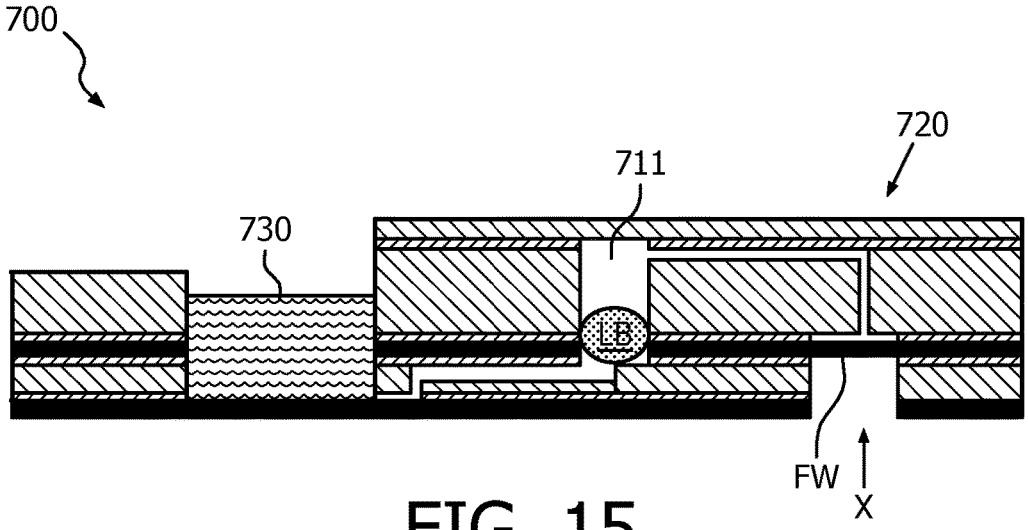
FIG. 15 shows a modification of the system of FIG. 14 in which the bead chamber has two compartments, one comprising a lyophilized bead and the other a flexible wall.
Figure 16:
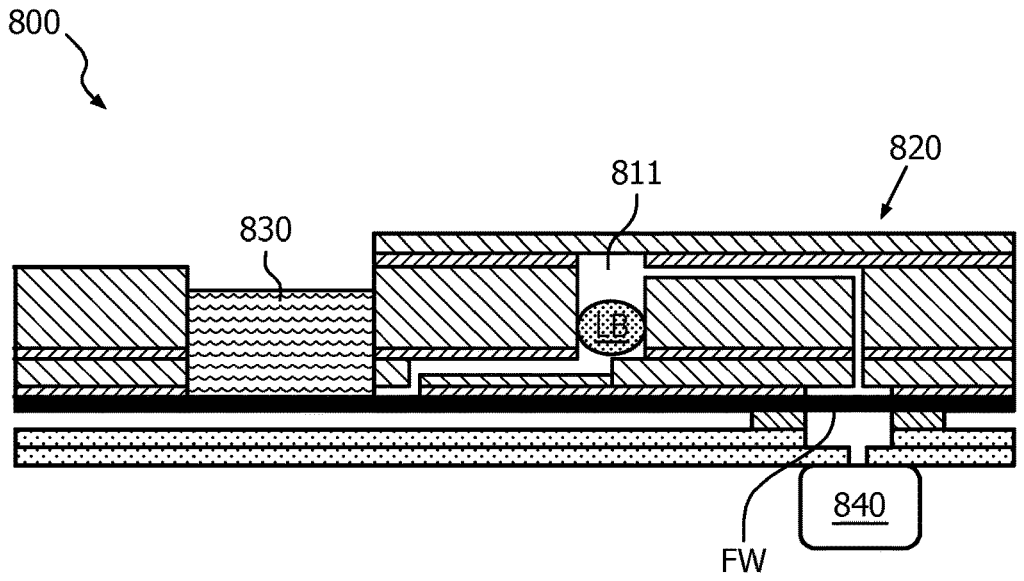
FIG. 16 shows a modification of the system of FIG. 15.

FIGS. 14, 15, and 16 illustrate three different embodiments of fluidic systems 600, 700, and 800 where the flexible foil FW is located further away in the channel.

The Figures illustrate two basic concepts: First of all, there is the general concept about a bead chamber having a flexible wall. Upon pumping the liquid to the chamber, the wall can expand. This wall can be located either close to the bead (even encapsulating the beads), as shown in FIG. 14, or it can be a bit further away in the fluidic system (FIGS. 15, 16). These embodiments can be characterized as operating "passively".

In FIG. 16, a fluid connection 840 is additionally shown. In this embodiment, the foil FW plays a more active role and this will facilitate flowing of the liquid into the bead chamber. Still the same kind of concept can be used to dissolve the bead LB and pump the dissolved bead back into the reaction chamber: By applying vacuum onto the foil FW, liquid can be sucked into the bead storage chamber. By then applying pressurized air, the foil can push the liquid back into the reaction chamber.

In order to allow for an outward bulging of the flexible foil FW when a vacuum is applied via the pumping device 840, a hole is provided in the table on which the cartridge 820 rests.

It should be noted that a pumping device could similarly be added to the systems of FIGS. 14 and 15, too (at the locations indicated with a letter "X"). Moreover, a valve could optionally be included in between the reaction chambers 630, 730, 830 and the associated bead chambers.

For all embodiments explained above, the manufacturing is relatively easy since no additional layers need to be made. The bead can just be put onto the "floor" layer, after which it is sealed with a flexible foil. As material of choice, the following can be used (these examples not being limiting): carrier material: PMMA; pressure-sensitive adhesive (polyester carrier): e.g. Nitto Denko 5015P; flexible foil: flexible rubber, such as an olefinic elastomer on PP basis, having a typical thickness of about 10-1000 μm, preferably about 100 μm.

Figure 17:
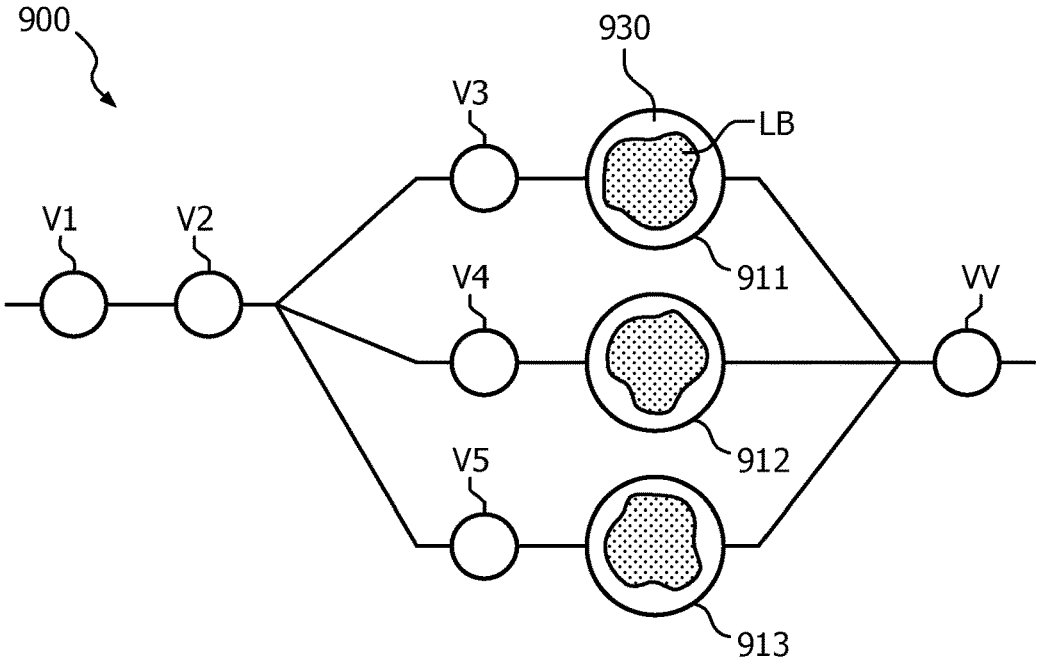
FIG. 17 illustrates a parallel arrangement of bead chambers.

In case multiple lyophilized beads are used, valves can be shared, as schematically shown in FIG. 17. In this case, for each bead LB three valves (V1, V2 and one of V3, V4 and V5) in a row can be used. Furthermore, also bead chambers can be set in series (cf. FIG. 1).

In summary, a further embodiment of a fluidic system has been disclosed that allows for the storage, dissolution and homogenization of lyophilized beads inside cartridges. This embodiment is characterized in the use of at least one flexible membrane (like a rubber foil). This flexible foil can expand (but does not have to for all embodiments) during pumping of the liquid into which the bead will dissolved in the bead storage chamber. Emptying of the cartridge is done by pumping the liquid out of the cartridge. The side(s) with the flexible membrane will then retract because of the under-pressure created by pumping the liquid out and thereby leaving only very limited dead volume behind in the bead storage chamber.

The described embodiments provide for an integration of lyophilized reagents in a microfluidic cartridge without having the disadvantage of the large volume of lyophilized beads (containing a lot of air). The dead volume is reduced by using a flexible wall and contacting the bead with liquid without having to fill the chamber completely. Upon contact the beads disintegrates and dissolves in the liquid. Having a flexible wall makes it easier to first accommodate the large volume of the bead and then reduce the chamber volume with the shrinkage of the bead during dissolution. Having multiple bead chambers in series and/or placed on a carousel are further measures to keep the volume as small as possible and make a cost effective solution for a complex cartridge (or a cartridge with a complex function). Being able to actuate the flexible wall is an extension particularly useful in combination with a technology that uses pneumatic driving with flexible membranes anyway.

All the described embodiments of the invention can be applied for any cartridge technology in which beads are stored that need to be homogenized and mixed. Applications can be e.g. PCR or qPCR, prot K treatment, sample preparation for nucleic acid detection, immuno-histochemical staining reactions, or the staining of tissue and cells for histopathology and cytopathology in general. The biological samples that can be analyzed comprise inter alia blood, urine, tissue, cells, buffers that contain pathogens, feces and the like.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A fluidic system for processing a sample fluid, comprising:

a cartridge including at least one reaction chamber for processing the sample fluid;

at least one bead chamber comprising a solid reagent selectively added to the sample fluid; wherein the at least one bead chamber comprises at least one flexible wall, wherein said flexible wall bulges outward, increasing the volume of the bead chamber such that the sample fluid is drawn in when a reduced pressure is applied to an outside of the flexible wall; and wherein the at least one bead chamber is separated by a destructible seal from the at least one reaction chamber.

2. A fluidic system for processing a sample fluid, comprising:

a cartridge including at least one reaction chamber for processing the sample fluid;

at least one bead chamber comprising a solid reagent selectively added to the sample fluid, wherein the at least one bead chamber comprises at least one flexible wall and at least two compartments, one compartment accommodating the reagent and the other compartment comprising the flexible wall; and wherein the at least one bead chamber is separated by a destructible seal from the at least one reaction chamber.

3. A fluidic system for processing a sample fluid, comprising:

a cartridge including at least one reaction chamber for processing the sample fluid;

at least one bead chamber comprising a solid reagent selectively added to the sample fluid; wherein at least two bead chambers are located on a movable carrier such that any bead chamber of the at least two bead chambers is selectively coupled to the at least one reaction chamber; and wherein the at least one bead chamber is separated by a destructible seal from the at least one reaction chamber.

4. The fluidic system of claim 1, wherein the reagent is lyophilized.

5. The fluidic system of claim 1, wherein the at least one bead chamber comprises at least two compartments, one compartment accommodating the reagent and the other compartment comprising the flexible wall.

6. The fluidic system of claim 1, wherein at least two bead chambers are located on a movable carrier such that any bead chamber of the at least two chambers is selectively coupled to the at least one reaction chamber.

7. The fluidic system of claim 6, wherein the carrier is a rotatable carousel.

8. The fluidic system of claim 6, wherein the carrier is attached to the cartridge.

9. The fluidic system of claim 6, wherein a movable intermediate element is disposed between the carrier and the cartridge.

10. The fluidic system of claim 1, further comprising at least two bead chambers that are fluidically connected in series, wherein consecutive bead chambers are separated by valves.

11. The fluidic system of claim 1, wherein the at least one bead chamber is connected to a vent port via a controllable valve.

12. The fluidic system of claim 1, further comprising a pressure source for selectively applying a pressure to the at least one reaction chamber.

13. The fluidic system of claim 1, further comprising a pressure source for selectively applying a pressure to the flexible wall.

14. A method for processing a sample fluid in a fluidic system, the method comprising:

storing a reagent in a solid form in a bead chamber of the fluidic system;

pumping liquid into the bead chamber to dissolve the reagent; and pumping the liquid with the dissolved reagent into a reaction chamber of the fluidic system, wherein the bead chamber comprises at least one flexible wall, the at least one flexible wall bulging outward increasing the volume of the bead chamber such that the sample fluid is drawn in when a reduced pressure is applied to an outside of the flexible wall, and wherein the bead chamber is separated by a destructible seal from the reaction chamber.

* * * * *